United States Patent [19]

McGinn

[11] 4,304,217

[45] Dec. 8, 1981

[54] ANTI-SMOKE EMITTING STOVE

[75] Inventor: Terrance E. McGinn, Sellersville, Pa.

[73] Assignee: Penn-Field Stove, Inc., Quakertown, Pa.

[21] Appl. No.: 178,093

[22] Filed: Aug. 14, 1980

[51] Int. Cl.[3] ..... F23L 3/00

[52] U.S. Cl. ..... 126/286; 126/290

[58] Field of Search ..... 126/190, 192, 197, 126, 126/77, 80, 286, 193, 290, 15 R, 21 R

[56] References Cited

U.S. PATENT DOCUMENTS

| | | | |
|---|---|---|---|
| 741,474 | 10/1903 | Webb | 126/286 |
| 2,032,252 | 2/1936 | Burrow | 126/286 |
| 4,030,479 | 6/1977 | Webb | 126/290 |

*Primary Examiner*—Albert W. Davis
*Assistant Examiner*—G. Anderson
*Attorney, Agent, or Firm*—Raymond Underwood

[57] ABSTRACT

A wood or coal burning stove has an air inlet opening in it which is controlled by a movable closure, a movable front door providing access to the interior fire box, and connecting linkage means which opens the closure when the front door is closed and shuts the closure when the front door is opened.

5 Claims, 7 Drawing Figures

ANTI-SMOKE EMITTING STOVE

This invention relates to stoves and particularly to wood and coal burning stoves which are located in residential rooms to heat them.

Stoves for this general purpose have been used for centuries because they supply warmth to a room, they tend to create a comfortable, cozy atmosphere and are simple to operate. Wood and coal have always been relatively freely available and at a comparatively cheap cost. In this respect they have avoided the complexity and high cost of fuel oil heating systems which require a large oil supply tank, an intricate oil burner and a source of electricity.

Because of the present day high cost of fuel oil there is a growing return trend to room size wood and coal burning stoves and because they are located within a living room, for instance, it is important that they do not emit any smoke into the room. There has to be an opening in the stove casing to the fire box, of course, so that fuel can be placed in the stove for burning. This access opening, in almost all instances, is closeable by doors so that smoke will not come out in the room.

Experience has shown that, very often, when the door is opened a puff or more of smoke will come out in the room. The opening movement of the door tends to draw some of the smoke with it and the movement of supply air into the fire box due to the draft through the stove, also tends to carry some smoke out of the door way which is being opened. This problem has been recognized but no satisfactory solution to it has been offered in the past.

The feature of the present stove is the provision of means which automatically minimize or alter the draft flow through the stove when the front door is opened so that smoke or other flame gasses will not tend to escape through the door opening.

Figure 1:
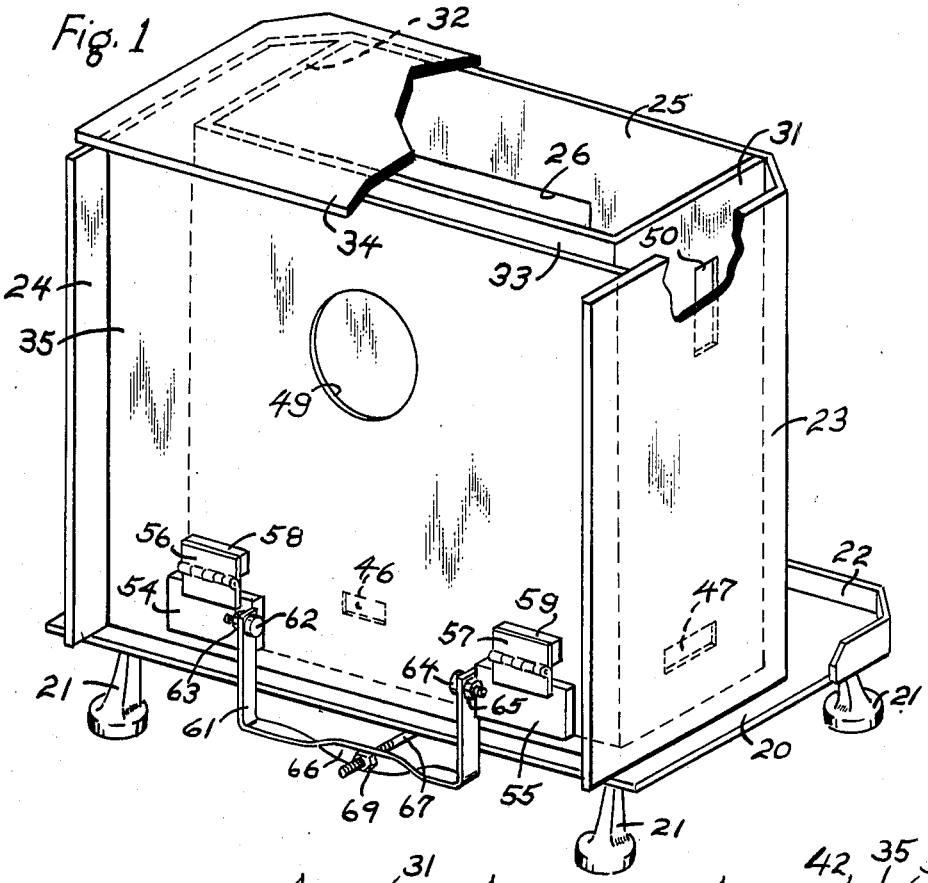
Figure 4:
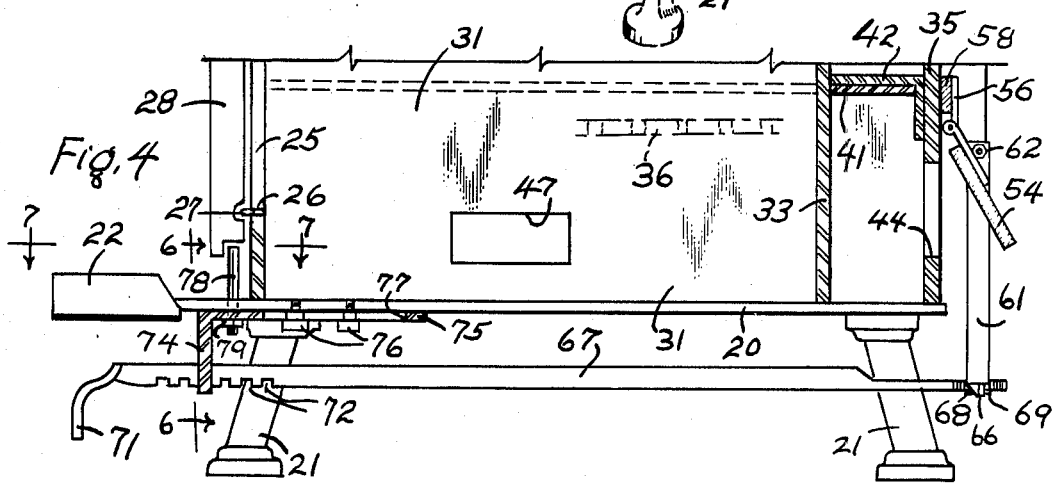
Figure 5:
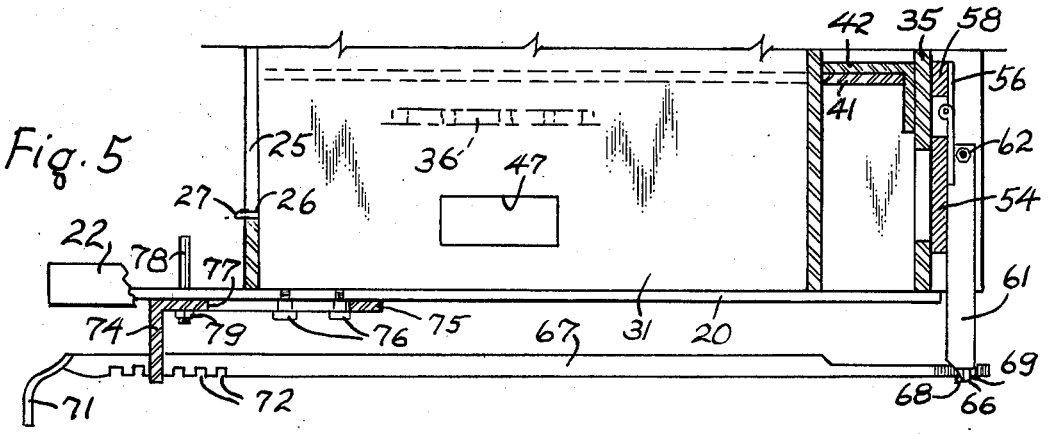
Figure 2:
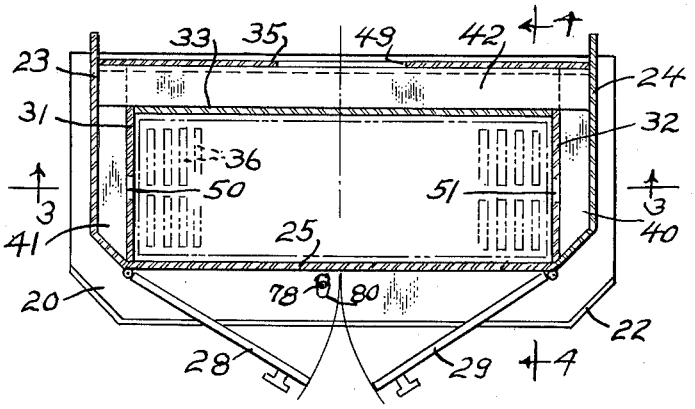
Figure 3:
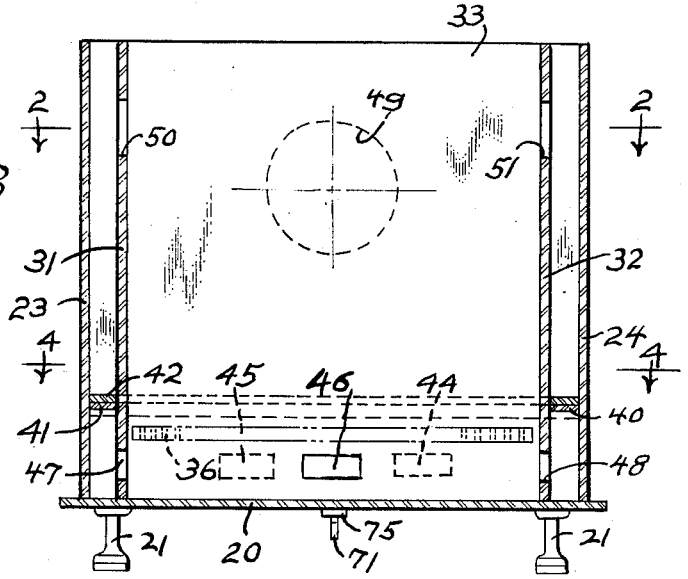
Figure 6:
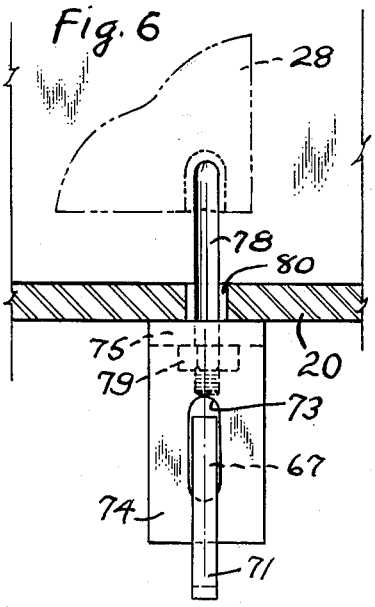
Figure 7:
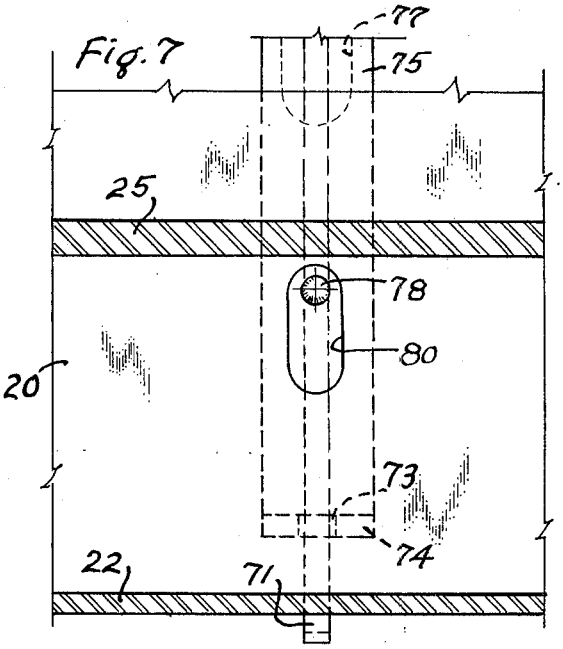

In the accompanying drawings:

FIG. 1 is a perspective view looking toward the rear of a representative embodiment of the invention, FIG. 2 is a plan view in section taken on the line 2—2 of FIG. 3, FIG. 3 is an elevational view in section taken on the line 3—3 of FIG. 2, FIG. 4 is a section on the line 4—4 of FIG. 2 on an enlarged scale, FIG. 5 is a section view like FIG. 4 but showing a different relationship of the movable parts, FIG. 6 is a section on the line 6—6 of FIG. 4 on a still larger scale and FIG. 7 is a section on the line 7—7 of FIG. 4 on a similar large scale.

In general, the stove has a fire box above a grate and ash pit and this fire box is partially surrounded by an inlet air supply chamber and also by an outlet smoke chamber which delivers the heated combustion products to the flue. The air supply chamber receives fresh room air through openings into it from the room and delivers this air to the ash pit and also partially directly into the fire box. The smoke chamber receives combustion products through an opening into the smoke box and after tortuously passing these hot gases within this chamber delivers them to the flue. This tortuous movement of the hot gasses in the smoke chamber plays them against the casing walls which radiate the heat into the room.

The openings to the air supply chamber are provided with adjustable closures which regulate the amount of incoming room air being supplied to the fire and these closures or doors may completely shut off this air supply. An important feature of the invention is that these closures automatically close the inlet openings when the front door is opened. This is achieved by the provision of operative connecting means between the front door and the closures for the air inlet openings.

The drawings illustrate these structures in detail as they show that the cabinet includes a base plate 20 which is oblong in shape and is made of cast iron or thick sheet metal. It is supported in a horizontal position above the floor by the four legs 21 one of which is at each corner. To the front edge is preferably affixed a vertical edging 22 to retain ashes on the base or bottom plate 20.

Attached to the top side of the bottom plate 20 is the three sided, vertical, outer shell portion made up of the sides 23 and 24 and the connecting front wall 25. The large opening 26 in this front wall 25 provides access to the fire box so that wood or other fuel may be supplied for the fire. A strip edging 27 is preferably welded around the edge of this opening to provide strength and to project slightly into a receiving channel of the doors to minimize leakage around the door.

The large front opening 26 is closed by the hinged doors 28 and 29 which slightly overlap, as in the usual practice, where they meet at the center. Two doors are shown here but there could as well be a single door hinged at either side of the opening. A latch should be provided in the conventional manner to serve to retain the doors in closed position.

Located within the outer shell 23, 24, 25 is the smaller upright three sided shell having the sides 31 and 32 and the rear wall 33. The front edges of the side walls 31 and 32 fit against the front wall 25 and are welded to it to form a gas seal. The walls 31, 32, 33 of the inner shell are the same height as the walls 23, 24, 25 of the outer shell so that the top or cover plate fits against them and may be welded to prevent escape of gas. A back or rear plate 35 extends from the bottom plate 20 up to the cover plate 34 and from the side wall 23 to the side wall 24.

The inner shell 31, 32, 33 forms the fire box and the usual grate indicated at 36 is supported above a space which forms the ash pit. The grate is supported in this position by lugs on the inner sides of the walls 31, 32, 33 or by support means which are otherwise provided. Preferably, a removable ash pan fits in the ash pit below the grate.

It will be noted that there is a space between the side walls of the inner and outer shells and between the back plate and the rear wall of the inner shell. Thus, the wall 31 is spaced from the wall 23, the wall 32 is spaced from the wall 24 and the wall 33 is spaced from the back plate 35; as a consequence there is a U-shaped space or passageway around the rear and sides of the inner shell, and it is closed in at the bottom by the base plate 20 and closed in at the top by the cover plate 34.

This U-shaped passageway is divided by a horizontal partition into a lower room air supply duct or chamber and an upper smoke and exhaust gas delivery duct or chamber. This dividing partition is made up of the side pieces 40 and 41 and the rear piece 42 and they can be of cast iron or heavy steel. Preferably, the rear piece 42 is an angle in cross section so that its rear vertical face will bear against the back plate 35 to form a tighter gas seal since this abutment cannot easily be welded together. These pieces can conveniently be welded at their edges where they contact the upright walls, to hold them in position.

The back plate 35 has two lower holes 44 and 45 through it at a level below the partition piece 42 for the inlet of room air. The walls of the inner shell also has holes through it below the horizontal partition and this places them below the grate. In the rear wall 33 is the hole 46, in the side wall 31 is the hole 47 and in the side wall 32 is the hole 48. Fresh air therefore, enters into the lower supply duct or chamber through the openings 44 and 45, sweeps through this chamber and enters into the space below the grate through the openings 46, 47, 48.

The back plate 35 additionally has the large, usually round flue hole through it above the partition piece 42, and this hole 49 generally has a short cylindrical extension welded in place to receive the smoke pipe. The side walls 31 and 32 of the inner upright shell have at their tops the exit holes 50 and 51 respectively. Smoke from the fire box, therefore exits from the fire box through these holes 50 and 51 into the upper exhaust gas delivery duct or chamber.

The hot combustion gases swirl around and within this exhaust chamber above the horizontal partition and exits through the flue hole 49. In passing through this upper exhaust chamber the hot combustion gasses play against the sides 23 and 24 of the outer shell and the back plate 35 as well as the top plate 34 and they become heated and radiate heat into the room. These heated surfaces cause hot convectious air currents as well.

It has been stated above that an important feature of the invention is the provision of automatically functioning means for closing the fresh air inlet openings 44 and 45 when the front doors 28 and 29 are opened. This same operative connection opens the inlets 44 and 45 when the front doors are closed so that the preexisting draft conditions are automatically resumed.

To block the opening 44 a door or closure 54 is provided and it swings on the hinge 56 which is attached as by welding to the spacer block 58 which is welded to the back plate 35. Preferably, the closure 54 is made of quite thick steel so that its own weight will cause it to hang down and fully obstruct the opening 44 but, of course, it could be of thin steel and be biased as by a spring to the closed position.

In like manner the closure 55 for the opening 45 is pivotably attached by the hinge 57 and spacer block 59 to the rear plate 35. To jointly move the closures 54 and 55 to open positions they are joined together by the U-shaped yoke 61. One upright end of this yoke is pivotally attached to closure 54 by the shoulder bolt 62 which is threaded in the nut 63 welded to closure 54; the other upright end of yoke 61 is similarly attached to closure 55 by bolt 64 and nut 65.

It will be noted that the nuts 63 and 65 are near the top edges of the respective closures so that the axis of the bolts 62 and 64 is a relatively short distance from the axis of the hinges 56 and 57. Because of this there is a leverage effect so that a short push or movement of the yoke serves to open the closures a considerable amount. In a reverse manner, if the yoke is holding the closures open, only a short movement of the yoke will let them fall to their closed positions.

The central portion of the yoke at 66 is turned at right angles to the end portions so that the portion 66 lies in a vertical plane. Through this portion 66 is a hole which receives the end of a pusher rod or shaft 67; this end is threaded and clamping nuts 68 and 69 are screwed on it on opposite sides of the vertical portion 66. Back and forth endwise movement of the shaft 67 correspondingly carries with it the shoulder nuts 62 and 64 to open the closures 54 and 55 or let them close. The clamping nuts 68 and 69 permit a fine adjustment of the disposition of the closures to carefully regulate the draft.

The pusher shaft 67 extends forwardly underneath the bottom plate 20 to about the forward edge of plate 20 and its forward end is provided with the handle or gripping element 71 so that the shaft can be manually manipulated. Along the under side of the push rod 67 and near its front end are a series of notches 72; the tooth portions are preferably about as wide as the transverse notches themselves.

The notched forward end of the push shaft 67 lies in a hole 73 through the decending portion 74 of an angular, connecting slide plate 75. The hole 73 is high enough so that the shaft or rod 67 can be lifted up and be moved to another notch which will engage the sides of the hanging portion 74. To movably hold the slide plate 75 against the under side of the bottom plate 20 the two shoulder bolts 76 pass up through an elongated slot 77 in the slide plate 75. This slot 77 is longer than the distance between the shoulder bolts 76 so that the slide plate has a free back and forth although somewhat limited endwise movement.

Obviously, the handle end 71 of the push rod 67 is held up against falling because of its location in the hole 73 of the descending portion 74 of the slide plate 75 which itself is held up by the shoulder bolts 76. Projecting upwardly from the slide plate 75 is a stud or bolt which is screwed into the plate 75 and is retained by the jam nut 79. This bolt 78 passes upwardly through a hole in the bottom plate 20 and this hole or slot 80 is elongated so that the bolt can move back and forth with the slide plate 75.

The top of the bolt 78 is in the closing pathway of the door 28 so that as the door is being moved to its fully closed position it pushes on the post 78 and moves it toward the front face of the front wall 25. This carries with it the slide plate 75 and the engagement of the hanging portion 74 with one of the notches 72, urges the pusher shaft 67 toward the rear of the stove. The connection of the shaft 67 to the yoke 61 and to the shoulder bolts 62 and 64 serves to move both closures 54 and 55 to an open position. Adjustment of the air supply is made by selecting the most appropriate notch 72.

When the door is opened it is followed by the post 78 under the force exerted by the weight of the heavy closures 54 and 55. A very slight opening movement of the door 28 results in a rapid drop and closing movement of the closures 54 and 55 due to the leverage relationship explained above. The air inlet openings 44 and 45 are blocked so soon after the front doors are opened even to a slight crack, that the draft flow is shut off and no smoke or combustion fumes spurt out of the front door. The chimney draft draws room air into the front opening of the stove and prevents escape of smoke as the normal draft up through the fuel is shut off.

Closing of the door reestablishes, automatically, the preexisting burning conditions.

I claim:

1. A stove comprising a cabinet having therein an internal fire box, said cabinet having through it an air inlet opening to supply exterior air to the fire box, an outlet opening to deliver combustion gases to a flue and a door opening which opens from the outside directly into the fire box for fuel supply to the fire box, the stove also including a movable closure for controlling air supply to said inlet opening, a movable door for covering said front door opening, a movable stud element disposed in the closing path of the front door, and operative connecting means between said stud element and said closure for establishing a reverse open and closed relationship between them whereby the closure is open when the door is shut and the closure is closed when the door is open, whereby when the front door is opened the air inlet opening is closed and the flue will thereby draw combustion gases from the fire box so they will not escape into the room.

2. A stove according to claim 1 in which said closure is hinged to the cabinet and said operative connecting means is attached to the closure close to the hinge axis so that the opening movement of the closure is multiplied.

3. A stove according to claim 1 in which said movable stud element is an upstanding post unconnected to the door but disposed in the closing path of the front door so that its movement due to shutting of the door is transmitted to open said closure.

4. A stove according to claim 1 in which the door opening is in the front of the cabinet and the air inlet opening is in the rear of the cabinet and said operative connecting means includes a pusher rod which is located underneath the cabinet and extends from the rear of the cabinet where it is attached at that end to said closure, to its other end where it is attached to an upstanding post disposed in the closing path of the front door so that its movement due to shutting of the door is transmitted to open said closure.

5. A stove according to claim 1 in which said movable stud element and operative connecting means includes a pusher rod which is attached at one end to said closure, a slide plate having an upstanding post disposed in the closing path of the front door, and connecting means between said slide plate and the other end of the pusher rod so that shutting movement of the door is transmitted to the closure to open it.

* * * * *